United States Patent [19]

Collin

[11] 4,026,679

[45] May 31, 1977

[54] APPARATUS FOR AND PROCESS OF CONVERTING CARBONACEOUS MATERIALS CONTAINING SULPHUR TO AN ESSENTIALLY SULPHUR-FREE COMBUSTIBLE GAS

[75] Inventor: Per Harald Collin, Falun, Sweden

[73] Assignee: Stora Kopparbergs Bergslags Aktiebolag, Falun, Sweden

[22] Filed: Mar. 8, 1976

[21] Appl. No.: 664,514

[30] Foreign Application Priority Data

Mar. 21, 1975 Sweden ..... 7503313

[52] U.S. Cl. ..... 48/73; 48/77; 48/197 R; 48/202; 110/1 J; 110/28 J; 201/31; 209/11; 252/373

[51] Int. Cl.[2] ..... C10J 3/20; C10K 1/20

[58] Field of Search ..... 48/202, 206, 210, 197 R, 48/61, 77, 71, 72, 73, 62 A; 209/214, 11; 110/1 J, 1 K, 28 J; 122/4 D, 5; 201/31; 252/373

[56] References Cited

UNITED STATES PATENTS

| | | | |
|---|---|---|---|
| 3,261,463 | 7/1966 | Eveson et al. | 209/11 |
| 3,481,834 | 12/1969 | Squires | 201/31 |
| 3,599,610 | 8/1971 | Spector | 122/5 |
| 3,625,354 | 12/1971 | Heitmann | 209/214 |
| 3,692,506 | 9/1972 | Johnson | 48/210 |
| 3,736,233 | 5/1973 | Sass et al. | 48/210 |
| 3,847,563 | 11/1974 | Archer et al. | 48/202 |
| 3,870,480 | 3/1975 | Moss | 48/206 |
| 3,957,459 | 5/1976 | Mitchell et al. | 48/197 R |

*Primary Examiner*—Robert L. Lindsay, Jr.
*Assistant Examiner*—George C. Yeung
*Attorney, Agent, or Firm*—Curtis, Morris & Safford

[57] ABSTRACT

A process for the conversion of carbonaceous materials containing sulphur to an essentially sulphur-free combustible gas by gasification, comprising partially gasifying the carbonaceous material in a first circulating fluid bed by supplying to said zone adjusted streams of the carbonaceous material, finely-divided CaO-containing material and steam, separating solid materials from streams of gases and solid materials leaving said reaction zone, subjecting an adjusted fraction stream of said solid materials to separation of ashes and sulphur purification and then returning this stream to the reaction zone, transferring the rest of the solid materials to a second circulating fluid bed, wherein the solid materials by partial combustion with an adjusted stream of gases containing molecular oxygen is heated to an overtemperature which is adjusted by controlling the content of oxygen of the gas in such a way that the materials after separation from the reaction gases and recirculation to the first fluid bed satisfies the heat requirement for the gasification therein. The invention also covers an apparatus for carrying out said process.

7 Claims, 1 Drawing Figure

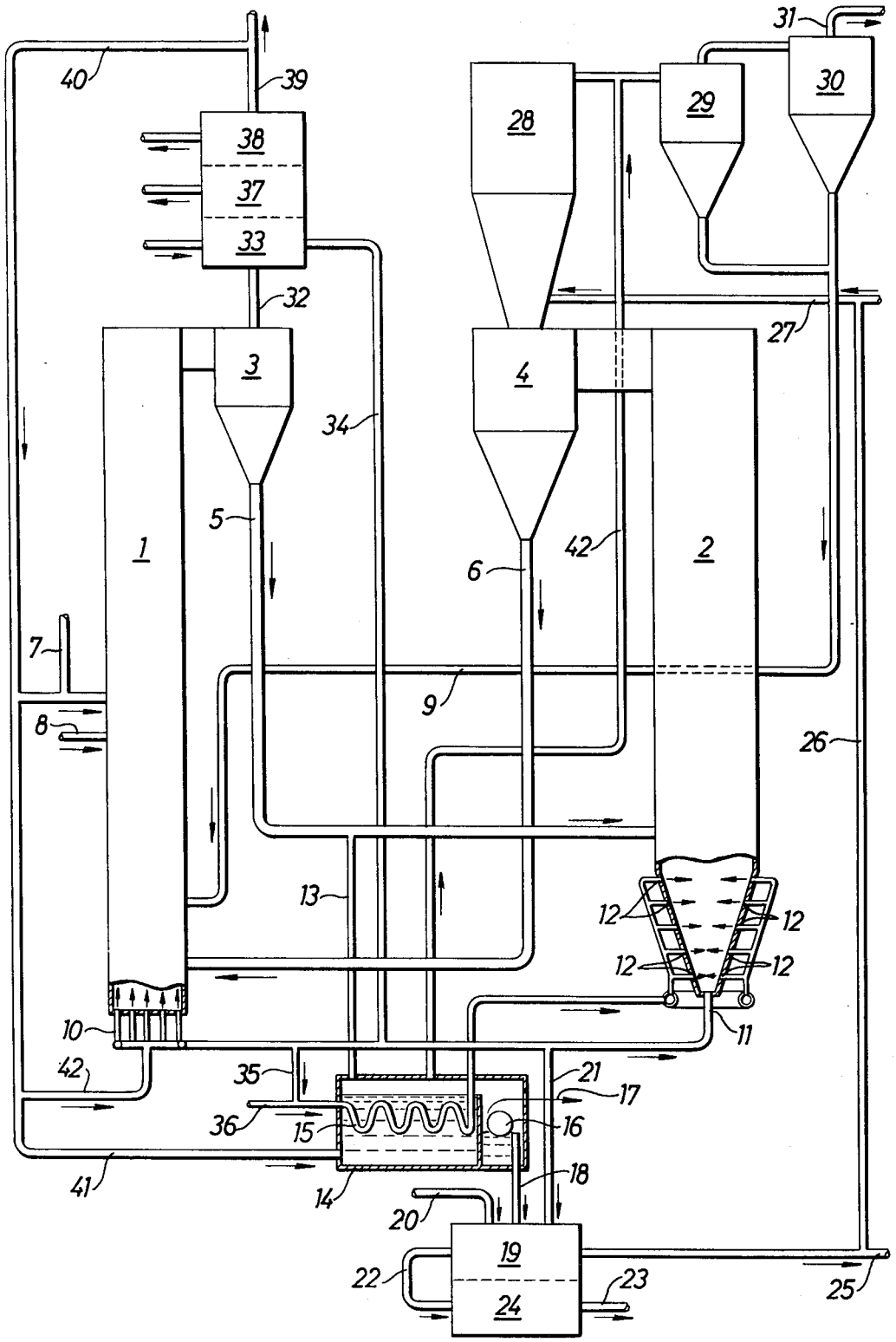
31
30
29
28
40
39
38
37
33
32
27
3
4
34
5
1
42
2
6
7
9
8
26
13
12
12
12
12
10
11
42
35
21
17
36
15
16
41
14
18
20
19
22
23
24
25

APPARATUS FOR AND PROCESS OF CONVERTING CARBONACEOUS MATERIALS CONTAINING SULPHUR TO AN ESSENTIALLY SULPHUR-FREE COMBUSTIBLE GAS

The present invention relates to a process for the conversion of carbonaceous materials containing fixed carbon and sulphur to an essentially sulphur-free combustible gas by gasification and partial combustion at an increased temperature and possibly increased pressure. By carbonaceous materials are meant solid and liquid carbonaceous materials which, when pyrolyzed, leave a carbon-containing residue, so-called fixed carbon, and furthermore contains volatile constituents, sulphur, ashes and moisture. By solid carbonaceous materials are meant for example finely divided coke, anthracite, black coal and brown coal, or mixtures of two or several of said materials. By liquid carbonaceous materials are meant hydrocarbons, liquid at reasonable temperatures, and not purified with regard to sulphur, such as fuel oils, tar oils and topped crude.

In the process according to the invention the carbonaceous material, after comminution of possible solid carbonaceous materials to a grain size of <3 mm, preferably <1 mm, is gasified with steam in a first circulating fluid bed maintained in a vertically elongated reaction zone. The conditions of existence of circulating fluid beds have been defined for example in Chemical Engineering Progress, Vol. 67, No. 2, 1971, pp. 58–63, L. Reh: Fluidized Bed Processing. The bed is maintained by supplying to the reaction zone controlled flows of carbonaceous materials, finely divided solid CaO-containing materials (for instance lime stone, dolomite, burnt lime stone or dolomite) and steam for fluidization and as an oxygen-bearing medium. The carbonaceous material supplied in such amounts that the bed always contains solid carbon, whether supplied as such or formed in the pyrolysis of liquid materials, generates by pyrolysis and reaction with the steam a combustible gas mixture containing $CO + H_2$. Simultaneously, sulphur purification takes place in view of the fact that sulphur released from the fuel is bound by the CaO-containing material. From the reaction zone a mixture of gas and solid bed materials leave and are separated into gases and solid materials. A fractional stream of the separated solid materials is freed from ashes and sulphur and returned to the above-mentioned fluid bed. This means that the contents of ashes and CaS in the solid materials are maintained at a suitable level.

The rest of the solid materials is transferred to a second circulating fluid bed, where by partial combustion with a controlled flow of a gas containing molecular oxygen, it is heated to an over-temperature adjusted by controlling the oxygen-content of the gas. After separation from the gas the solid materials leaving the second circulating fluid bed is returned to the first fluid bed. The over-temperature of the solid materials is adjusted so as to cover the heat-requirement of the first fluid bed. The two fluid beds thus cooperate in a kind of cross-connection, where the first fluid bed generates a nitrogen-free combustible gas, whereas the second bed generates nitrogen-containing combustible gas and heat. This heat is to a great extent transferred to the first bed with the solid materials. This is possible thanks to the large circulation of solid materials in the circulating fluid bed.

During the partial combustion in the second circulating fluid bed, which is also maintained in a vertically elongated reaction zone, it is suitable to supply the optionally heated gas containing molecular oxygen, for instance air, divided into a number of small fractional streams into the lower part of the reaction zone, not, however, through the bottom. In order to maintain fluidization at the bottom of the zone a non-oxidizing gas, for example flue gases and/or steam, is supplied through the bottom. In the bed fluidized in this way the gas containing molecular oxygen is supplied divided up into several fractional streams so as to be rapidly intermixed with the passing mixture of gas and solid materials, local super-heating during the partial combustion with the oxygen of the gas being delimited and controlled. In order to prevent depositions on the walls of the reaction vessel, local overheating near the walls must be avoided, which is suitably done by directing the jets of the gas containing molecular oxygen away from the walls. Suitably, the angle between jet and wall should be at least 10°. Moreover, the jets must not be so powerful as to penetrate and to come close to an opposite wall, which is obtained by selecting a sufficiently great number of small fractional streams. These streams are suitably distributed across the reaction zone, both vertically and circumferentially. In order to provide for the desired heat-balance a sufficient over-temperature in the second fluid bed is, according to the invention, obtained by controlling the oxygen-content of the supplied gas containing molecular oxygen. This control is best done by diluting the gas with inert gases, flue gases and/or steam.

The hot purified gas from the first fluid bed consists essentially of $CO + H_2$, but contains also mall percentages of $CO_2$ and $H_2O$ and is free from nitrogen and essential free from sulphur in view of the fact that sulphur supplied with carbonaceous material has been bound by CaO present in the zone, under the formation of CaS. After cooling while recovering the heat-content, for instance by generation of the steam for the gasification, condensation of steam and absorption of $CO_2$, a high-value gas is obtained which advantageeously can be used as a synthesis gas and/or after methanization as a synthetic natural gas (SNG).

The hot purified gas from the second fluid bed contains $N_2$, CO, $CO_2$, $H_2$ and $H_2O$, and its energy-content is according to the invention utilized for the generation of electricity in a thermal power station. From reasons of heat economy it is, however, suitable first to utilize part of the physical heat content of the gas by bringing the gas into contact with $CaCO_3$/CaO-containing materials in a venturi bed with separating means arranged after the bed. This results in heating of the $CaCO_3$/-$CaO_2$-containing materials and their $CaCO_3$-content is decomposed to CaO which reacts with any residual $H_2S$ in the gas while forming CaS. At adjusted (see below) flow of $CaCO_3$/CaO-containing material the gases leaving the venturi bed will be essentially free from sulphur, the above-mentioned thermal power station being environmentally acceptable. The CaO/CaS- -containing materials separated in a cyclone(s) after the venturi bed is according to the invention supplied to the first fluid bed. In said bed, where strongly reducing conditions are prevailing, the materials bind further amounts of sulphur originating from the input of carbonaceous materials. The Ca-content of the bed materials are maintained, suitable in the manner as indicated below, at such a level that the CaO-content of the CaO/CaS-containing component in the bed materials leaving the upper part of the first fluid bed is higher than its CaS-content.

In order to avoid accumulation in the system of said CaO/CaS-containing component and of ashes remaining after the gasification of the carbonaceous materials, the invention comprises cooling of an adjusted fractional stream of solid materials separated in the separating means after the first fluid bed and containing particles of coke, ashes and CaO/CaS-containing materials below the Curie-point of the iron content of the ashes, the fractional stream being then subjected to magnetic fractionation. The cooling is carried out in such a manner that heat is recovered which, in accordance with the invention, is suitably carried out by using as an in-direct cooling medium the gas containing molecular oxygen before its feeding to the second fluid bed. The gas is hereby pre-heated, which is advantageous from the point of view of heat economy.

In the magnetic fractionation of the fractional streams materials from the separating means after the first fluid bed there is obtained a magnetic fraction essentially consisting of ashes, the iron content of which is partly reduced and is present as Fe and/or $Fe^{2+}$. This fraction is dumped whereby accumulation of ashes in the system is avoided. The contents of ashes in the two fluid beds are controlled by means of the proportion of the stream of materials from the first fluid bed which is passed on to the magnetic fractionation. In order to obtain an effective and uninterrupted operation it has generally been found to be suitable to delimit the content of ashes, but the suitable level is depending on the composition of the ashes and must be established from case to case.

The non-magnetic fraction consists essentially of coke and Ca0/CaS-containing component. To recover the contents of coke and Ca of the fraction, the invention comprises the convertion in a manner known per se, of the CaO/CaS-content to elementary sulphur and $CaCO_3$. Sulphur is recovered, whereas $CaCo_3$-containing component in admixture with the coke content of the fraction, are recycled to the first fluid bed after thermodecomposition, of $CaCO_3$ to CAO in the venturi bed in the manner described above. In order to avoid accumulation in the system of certain constituents present in the non-magnetic fraction in small amounts and not containing Ca, such as $Al_2O_3$ and $SiO_2$, it is suitable to bleed a smaller part (<10%) of the fraction and to dump said part. As a replacement herefor, a balanced stream of external $CaCO_3$-containing material is supplied, for example limestone and/or dolomite.

Since in principle Ca circulates within the system the Ca-content of the bed materials from the first fluid bed is adjusted to about the desired level by time delimited over or under balancing of the flow of limestone and/or dolomite to the venturi bed.

In the following the process according to the invention will be more closely described in connection to the drawing showing diagrammatically an apparatus for carrying out the invention.

The apparatus consists of a first circulating fluid bed 1 and a second circulating fluid bed 2 enclosed in shafts with associated separating means 3, 4 for solid materials and recirculating conduits 5, 6 transferring the separated solid materials from the first circulating fluid bed 1 to the second circulating fluid bed 2 and the separated solid materials from the latter to the first circulating fluid bed 1.

Finely divided solid 7 and/or liquid 8 carbonaceous materials containing sulphur, finely divided CaO-containing materials 9 and steam 10 as a fluidizing agent and oxygen-bearing medium are supplied to the first circulating fluid bed 1. From the upper part of the bed a mixture of solid materials and gases separated in the separating means 3 are discharged. In the fluid bed 1 the desired gasification temperature, i.e. >750° C, suitably 850° – 1150° C, is maintained by means of the solid materials returned from the second fluid bed 2 through the recirculation conduit 6 and heated to a controlled temperature.

In the second circulating fluid bed 2 the materials transferred from the first bed through conduit 5 are fluidized, partly by a small flow of steam introduced into the bottom through conduit 11, partly by means of a mixture of preheated air and steam introduced through a number of horizontal nozzles 12 opening at spaced apart locations in several levels in the lower conical part of the shaft. This distribution into fractional streams is necessary to prevent a too high heat-generation per unit of volume in said part, which will prevent local over-heating and eliminate formation of disturbing agglomerates.

The molecular oxygen of the supplied gas provides for partial combustion of the coke thereby generating, in comparison with the temperature of the first fluid bed 1, an over-temperature in the solid materials returned through separating means 4 and recirculation conduit 6. The over-temperature is controlled to an adjusted level by controlling the oxygen-content of the gas mixture.

A fractional stream 13 of solid materials leaving the first fluid bed 1 is cooled in a classical fluid bed 14 having built-in cooling surfaces 15 to a temperature below the Curie-point of iron, whereafter it is magnetically fractionated 16, for instance in the manner described in U.S. Pat. appln. Ser. No. 543486, now U.S. Pat. No. 4,000,060. This results in a magnetic fraction 17 essentially consisting of ashes from supplied solid carbonaceous materials and the irom contents of which is partly present as Fe or $Fe^{2+}$. The magnetic fraction 17 is dumped and the fractional stream 13 controlled in such a manner that the contents of ashes in both fluid beds do not disturb gasification or partial combustion therein. The characteristics of the ashes determine said fractional stream, and the lower the softening temperature of the ashes is, the lower contents of ashes must be maintained in the zones.

The non-magnetic fraction 18 obtained in the magnetic fractionation 16 consists essentially of coke and CaO/CaS-containing materials. In order to recover the contents of the fraction of sulphur, coke and Ca, said fraction, suitably in a circulating fluid bed, is, in a manner known per se, at 19 brought into contact with adjusted streams of $CO_2$ and $H_2O$-steam, supplied at 20 and 21, respectively, at 550° – 750° C and >2 atm gauge. This results in removal of the major part of the sulphur-content of the fraction in the form of $H_2S$ (22), which is converted into elementary sulphur 23 in a manner known per se, for example in a Claus-process 24.

The bed material content of the desulphurizing bed 19 is maintained constant by controlled discharge. Discharged materials consisting essentially of coke and $CaCO_3$-containing material but also containing small amounts of inert non-magnetic substances, such as $A1_2O_3$ and $SiO_2$. To prevent accumulation of such substances in the system a small part is dumped at 25 usually <10%) of materials discharged from the desulphurizing bed. The Ca-content of the major part 26 is supplemented by balanced addition of externals $CaCO_3$-containing material, such as limestone and/or dolomite, at 27. The materials are then passed on to a venturi bed 28, wherein it is brought into contact with the hot exhaust gases from the separation means. This results in thermal decomposition of the major part of the $CaCO_3$-content into CaO and the material is carried by the gas to separating means 29, 30 where coke and CaO-containing materials 9 are separated. This results in absorption of the major part of possible $H_2S$ in the gases from the separating means 4 after the second fluid bed in the form of CaS, and the gases 31 leaving separating means 29, 30 after the venturi bed 28 are essentially free from sulphur.

The solid materials from the separating means 29, 30 after venturi bed 28 containing coke and Ca-containing materials, the major part Ca thereof being bound as CaO but also to a small extent as CaS and $CaCO_3$, are through 9 supplied to the first fluid bed 1. In said bed where strongly reducing conditions are prevailing, the CaO-content absorbs $H_2S$ formed in the heating of the sulphur content of the carbonaceous materials introduced 7 in the first fluid bed. In this way the gases 32 from the separating means 3 will be essentially free from sulphur.

The heat content of the gases 32 from the first fluid bed is utilized for the generation of steam at 33, which steam partly through 34 is used as a fluidizing gas in the two fluid beds where the steam is supplied through nozzles 10, 11 at the bottoms, partly through 35 after mixing with air at 36 and after preheating in the cooling device for the solid materials 13 discharged from the classical fluid bed 14 is used as a gas containing molecular oxygen for the partial combustion in the second fluid bed. The gases are then, in a manner known per se, by washing at 37 and absorption at 38 freed from their contents of steam and $CO_2$. The purified gases 39 contain essentially $H_2$ and CO but also hydrocarbons, such as $CH_4$ and $C_2H_4$. The content of hydrocarbons is depending on the fraction of volatiles supplied in the carbonaceous materials, the residence time for the volatiles in the first fluid bed and the gasification temperature therein. Thus, the content of hydrocarbons decreases with increased residence time and increased temperature.

The gases 39 have a high heat value and may advantageously be used as a fuel or as a synthesis gas after possible further purification. After methanization in a manner known per se they may also advantageously be used as a synthetic natural gas. A fractional stream 40 of the cooled combustible gases 39 is used partly for feeding possible solid carbonaceous materials at 7 to the first fluid bed, partly through 41 as a fluidizing gas in the classical fluid bed 14. Possibly also a part 42 of this part-flow 40 in admixture with steam may be used as a fluidizing gas in the first fluid bed. The gases leaving the classical fluid bed 14 are admixed with the gases leaving the venturi bed 28 to make use of the heat content of said gas.

The gases 31 from the separating means 29, 30 after the venturi bed 28 is combustible and contains $N_2$, $H_2$, CO. $CO_2$ and $H_2O$. It is suitably used in a hot condition for the generation of electricity in a thermal power station. Since the gases 31 are essentially free from sulphur such heat power station will be environmentally acceptable.

In order to maintain a low sulphur content in the gases 31 it has been found, in accordance with this invention, to be suitable to maintain such high CaO-content in the CaO/CaS-containing component of the solid materials leaving the separation means 13 after the first fluid bed through 5 that its CaO-content is higher than its CaS-content. Since the major part of the Ca-content of the system circulates within the system, the CaO-content of the first fluid bed is controlled at about a desired level by time limited over- or underbalancing of the flow 27 of external $CaCO_3$-containing materials supplied to the venturi bed 28.

What is claimed is:

1. An apparatus for carrying out the process for the conversion of carbonaceous materials containing sulphur to an essentially sulphur-free combustible gas by gasification at an increased temperature including gasification vertical refractory-lined furnace shafts each of which are interconnected to means for separating of solids and gases, a first plurality of nozzle means and inlet pipe means for supplying carbonaceous materials, steam, and CaO-containing material to the first shaft, conduit means for separating gases and solids of the first shaft to the second shaft, second conduit means for removing a fractional stream of solid materials from said means for separating solids and gases of said first shaft interconnected for separating from said fractional stream ashes and sulphur, third conduit means for returning said ash and sulphur free purified materials separated from said means for separating of solids and gases to said first shaft, fourth conduit means for transferring the remainding stream of solid materials to the second shaft, fifth conduit means for returning solid materials exposed to overtemperature from the second shaft to the first shaft so as to satisfy the heat requirement for the gasification therein, a second plurality of nozzle means for supplying steam and gas containing molecular oxygen to the second shaft for partial combustion with said remainding stream of solid materials, sixth conduit means for removing combustible nitrogen-free gases from the first shaft, and seventh conduit means for removing combustible nitrogen containing gases from the second shaft, said combustible gases being removed from the shafts and being essentially free of sulfur.

2. A process for the conversion of a carbonaceous material containing sulphur to an essentially sulphur-free combustible gas by gasification, at an increased temperature or increased temperature and increased pressure, comprising (a) partially gasifying, in a first circulating fluid bed maintained in a vertically elongated reaction zone, the carbonaceous material including gasifying solid carbonaceous materials which have been disintegrated to a grain size of <3 mm, said partial gasification being accomplished by supplying to said zone adjusted streams of the carbonaceous material, finely-divided CaO-containing material and steam; (b) separating solid materials from the stream of combustible gases and solid materials leaving said vertically elongated reaction zone; (c) separating further ashes and sulphur from an adjusted fraction of a stream of said solid materials and then returning said stream to the reaction zone; (d) transferring the remainder of the solid materials to a second vertically elongated reaction zone, wherein the solid materials by partial combustion with an adjusted stream of reacting gases containing molecular oxygen is heated to an overtemperature and a stream of partial combustion product gases and solid materials is produced; and (e) adjusting said overtemperature in the second fluid bed by controlling the content of oxygen in said reacting gases so that said solid materials after separation from the partial combustion gases and recirculation to the first fluid bed satisfies the heat requirement for the gasification in said first circulating fluid bed, said partial combustion product gases being essentially free of sulfur.

3. A process according to claim 2, wherein the gas containing molecular oxygen is supplied to the reaction zone of the second circulating fluid bed divided into a number of small fractional streams suitably forming jets directed away from the walls, and introducing non-oxidizing gas through the bottom of said reaction zone.

4. A process according to claim 2, wherein said fraction of the stream of said solid materials from the first circulating fluid bed is adjusted in such a manner that the ash contents of the two fluid beds do not reach a level interfering with the gasification and the partial combustion.

5. A process according to claim 2, wherein the supply of finely-divided CaO-containing material is adjusted in the first fluid bed, and the fractional stream of said solid materials is discharged from the first fluid bed in such a manner that the CaO-content of said materials is higher that its the CaS-content thereof.

6. A process according to claim 2, wherein the fractional stream of solid materials discharged from the first fluid bed is cooled under the Curie-point of iron, and said fractional stream separated magnetically in a magnetic fraction essentially containing ashes, said fraction being dumped, contacting the non-magnetic fraction containing coke, CaO and CaS in a fluid bed under increased temperature and increased pressure with steam and $CO_2$ for converting CaS to $CaCO_3$ and $H_2S$, said solid materials containing $CaCo_3$ and said solid materials being then returned to said first fluid bed.

7. A process according to claim 2 utilizing available energy content of purified discharge gases from the second circulating fluid bed for the generation of electricity in a thermal power station including utilizing said energy subsequent to utilization of part of the heat content of said discharge gases for thermal decomposition of $CaCO_3$.

* * * * *